US011224964B2

(12) United States Patent
Wang

(10) Patent No.: US 11,224,964 B2
(45) Date of Patent: Jan. 18, 2022

(54) DOVETAIL ANCHOR NUT

(71) Applicant: Henry Wang, Winter Springs, FL (US)

(72) Inventor: Henry Wang, Winter Springs, FL (US)

( * ) Notice: Subject to any disclaimer, the term of this patent is extended or adjusted under 35 U.S.C. 154(b) by 142 days.

(21) Appl. No.: 16/582,556

(22) Filed: Sep. 25, 2019

(65) Prior Publication Data

US 2021/0086346 A1 Mar. 25, 2021

(51) Int. Cl.
*B25H 1/08* (2006.01)

(52) U.S. Cl.
CPC ..... *B25H 1/08* (2013.01)

(58) Field of Classification Search
CPC ..... B25H 1/08
USPC ..... 269/309
See application file for complete search history.

(56) References Cited

U.S. PATENT DOCUMENTS

| | | | | |
|---|---|---|---|---|
| 2,175,632 | A | 10/1939 | Maga | |
| 4,027,711 | A | 6/1977 | Tummarello | |
| 4,818,163 | A | 4/1989 | Bereiter et al. | |
| 5,797,164 | A | 8/1998 | Donaghy | |
| 7,241,094 | B1 | 7/2007 | Potts et al. | |
| 9,032,684 | B2 | 5/2015 | Huff | |
| 9,091,053 | B2 * | 7/2015 | Labonte | E04B 9/22 |
| 9,637,933 | B2 | 5/2017 | Zhou et al. | |
| 2009/0013635 | A1 | 1/2009 | Nagaiwa et al. | |
| 2014/0245678 | A1 | 9/2014 | Mathews et al. | |
| 2015/0343607 | A1 * | 12/2015 | Wang | B27B 27/10 269/249 |
| 2017/0298616 | A1 * | 10/2017 | Zhang | E04C 3/09 |
| 2018/0099404 | A1 | 4/2018 | Wang | |
| 2018/0320365 | A1 * | 11/2018 | Albartus | F16B 2/005 |
| 2020/0338717 | A1 | 10/2020 | Pugh | |

OTHER PUBLICATIONS

MATCHFIT Dovetail Hardware Variety Pack. (May 14, 2019). https://www.amazon.com/MATCHFIT-Dovetail-Hardware-Variety-Pack/dp/B07RT1X2JX/ref=sr_1_244_sspa. Accesed on Jul. 7, 2021. (Year: 2019).*

* cited by examiner

*Primary Examiner* — Lee D Wilson
*Assistant Examiner* — Jonathan G Santiago Martinez
(74) *Attorney, Agent, or Firm* — Wolter Van Dyke Davis, PLLC; Robert L. Wolter

(57) ABSTRACT

An apparatus, having an elongated main body (102) with a dovetail shape, a top surface (104), a bottom surface (106), a side surface (108) connecting the top surface and the bottom surface, a first end (120), a second end (122), and a chamfer (124) at a corner (126) of the side surface and the bottom surface at the first end. A size and shape of the elongated main body matches a size and shape of a frustoconical section (520) of a dovetail slot into which the elongated main body slip fits. A bottom (522) of the frustoconical section is spaced apart from a bottom of the dovetail slot.

14 Claims, 19 Drawing Sheets

DOVETAIL ANCHOR NUT

FIELD OF THE INVENTION

The invention relates to a dovetail anchor meant to fit within a dovetail slot.

BACKGROUND OF THE INVENTION

Woodworking enthusiasts and professionals rely on worktables with recessed channels to secure workpieces. The recessed channels may take various shapes known to the Artisan, include T-slots and dovetail slots. T-slots are used extensively in the machining of metals as well. For example, T-slots can be frequently found on milling machine tables and drill press tables. Both T-slots and dovetail slots are found in woodworking apparatuses.

With respect to these woodworking apparatuses, such as cutting devices (i.e., table saws, routers and band saws), or worktables, clamps may be used in conjunction with the slots to secure a workpiece or an auxiliary fence. Similarly, clamps may be used to affix wood boards to benches to increase working area space.

Prior art auxiliary fences often include extruded metal (aluminum) members that are recessed into the worktable and include the T-slot shape or the dovetail shape. However, these metal members are limited in size because of manufacturing cost and weight. In addition, the channels for receiving clamps extend in only one direction. That is, the extruded metal fences cannot be manufactured to include channels in multiple directions. Accordingly, woodworking enthusiasts and professionals often use wood boards as auxiliary or sacrificial fences that are adapted to receive clamps so that a flush work surface is available. More specifically, channels may be formed within the board to receive a clamp post.

Alternatively, T-shaped grooves or channels have been formed on one side of the board to receive a T-shaped clamping post of a clamp, but the cross-sectional dimensions of these channels are not standardized and the end users have difficulties in cutting the properly sized grooves to receive T-shaped clamping posts of a clamp. In addition, the T-shaped channels if cut too deep may compromise the structural integrity of the work surface. If cut too shallow, the T-shaped channels form thin strips of wood on the clamp side, which strips can readily break thereby comprising the attachment of the auxiliary fence to the machine fence of the woodworking apparatus.

In response, Micro Jig of Winter Park, Fla. has developed a line of products associated with a standardized dovetail slot easily formed by a conventional dovetail router bit with, for example, ½" shank and a 14° taper. A channel formed using the above described ½" router bit may have a width about 0.500" at its widest that tapers to a width at an opening of the channel. In addition, the channel 34 may have a depth dimension of about 0.375". Each side is angled towards the other toward a top of the slot, and each side is angled at about 14° from vertical.

An example product that works with the above dovetail slot is Microjig's MATCHFIT™ clamp. This clamp is disclosed in U.S. Pat. No. 10,099,398 to Wang, which is incorporated herein by reference in its entirety, and its continuation application Ser. No. 16/110,747 to Wang filed Aug. 23, 2018 also incorporated herein by reference in its entirety. A worktable suitable for use with the clamp is disclosed in U.S. application Ser. No. 15/290,681 to Wang filed Oct. 11, 2016 and incorporated herein by reference in its entirety, and in U.S. application Ser. No. 15/788,311 to Wang filed Oct. 19, 2017 also incorporated herein by reference in its entirety.

A clamp post of the clamp that fits into the dovetail slot includes a shape that conforms to that of the dovetail slot described above. For example, the clamp post may have a width dimension of less than 0.50" and preferably about 0.4", and a height dimension of about 0.2", and preferably about 0.24".

These products are experiencing commercial success, so Microjig continues to develop products associated with the dovetail slot.

BRIEF DESCRIPTION OF THE DRAWINGS

The invention is explained in the following description in view of the drawings that show:

FIG. 13A is a close-up view of FIG. 13.

DETAILED DESCRIPTION OF THE INVENTION

Figure 1:
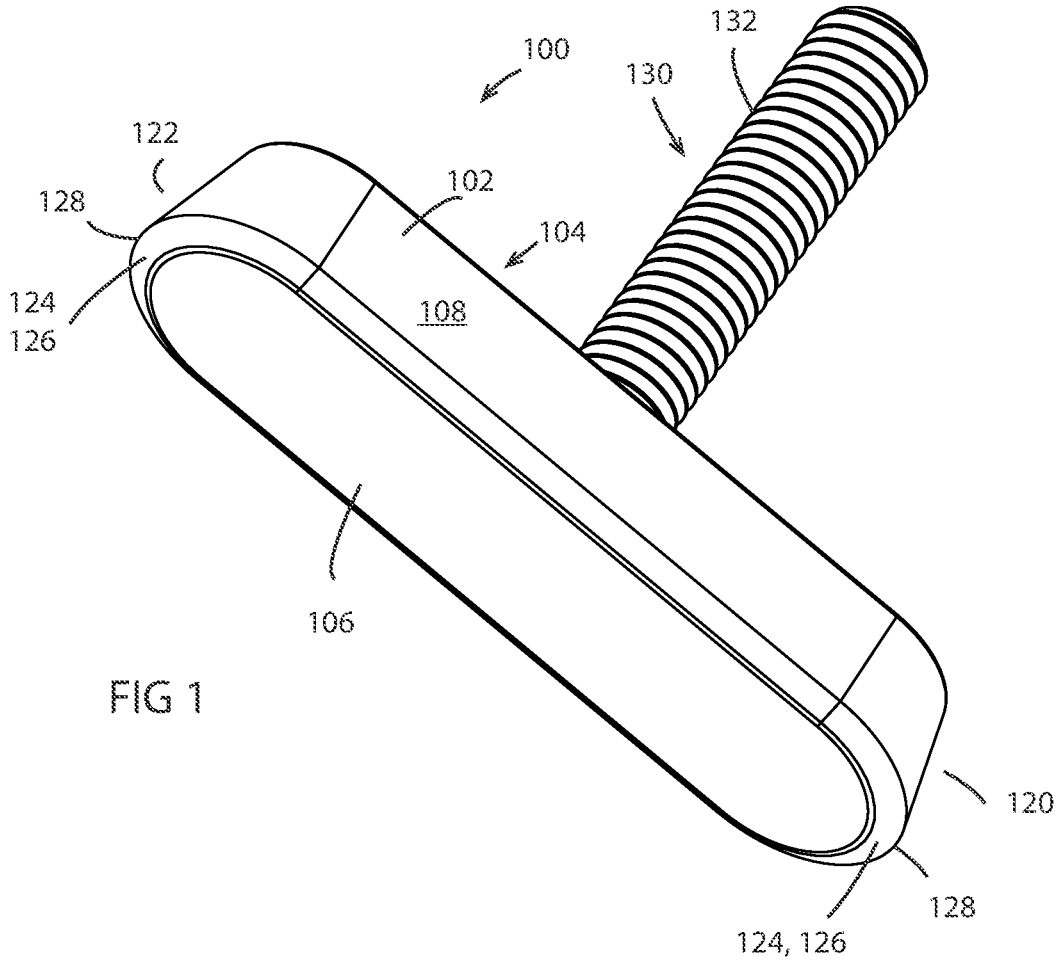
FIG. 1 is a perspective view of an embodiment of the dovetail anchor nut.

FIGS. 1-5 illustrate an embodiment of a dovetail anchor nut 100. The dovetail anchor nut 100 includes an elongated main body 102 having a dovetail shape, a top surface 104, a bottom surface 106, a side surface 108 connecting the top surface 104 and the bottom surface 106, a first end 120, a second end 122, and a chamfer 124 at a corner 126 of the side surface 108 and the bottom surface 106. In this embodiment, the elongated main body 102 is elongated. Also, in this embodiment the first end 120 and the second end 122 are rounded. However, one or both of the ends may not be rounded. The chamfer 124 is shown extending fully around the elongated main body 102. However, the chamfer 124 may alternately be present at the first end 120 only, the second end 122 only, or not present at all. The first end 120 and the second end 122 are tapered inward from a top 128 of the chamfer 124 to the top surface 104. In this embodiment, a stud 130 with a male thread 132 protrudes from the top surface 104.

Figure 2:
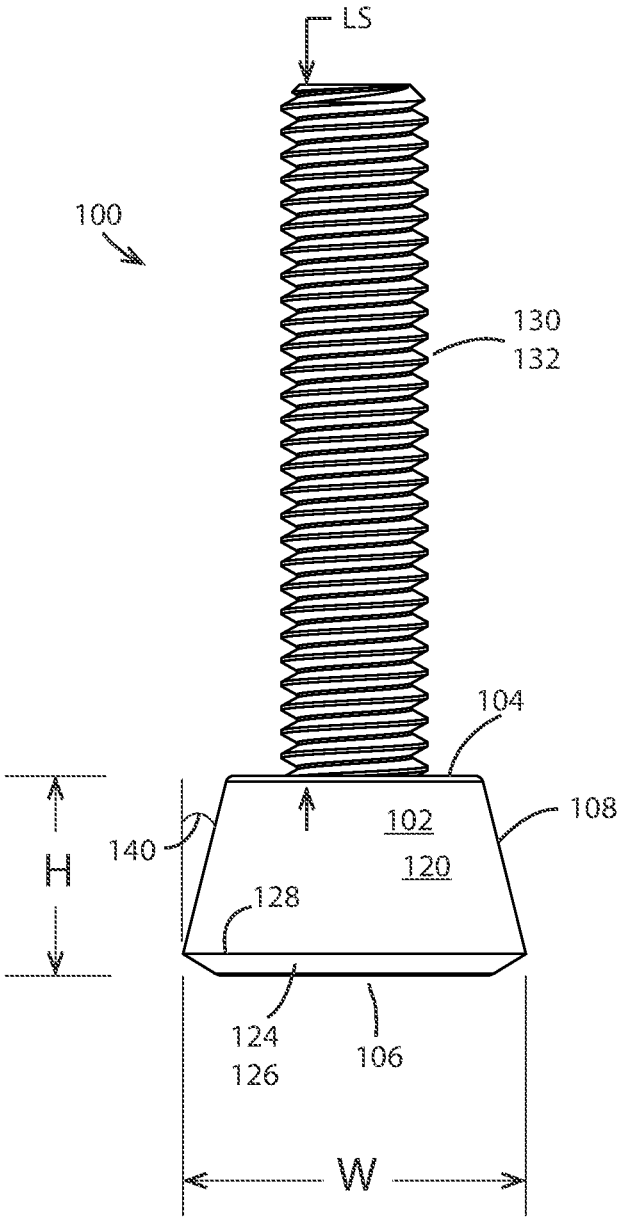
FIG. 2 is an end view of the dovetail anchor nut of FIG. 2.

As is best seen in FIG. 2, the elongated main body 102 includes a dovetail shape. This dovetail shape corresponds to a shape of a slot made by a conventional ½" dovetail router bit having a 14 degree taper as is disclosed below. Accordingly, the elongated main body 102 includes a width of less than ½". In various embodiments, a width W can range from 0.44 to 0.46". The side surface 108 tapers toward the top surface 104 at a side taper angle 140 that cooperates with the 14 degree taper of the conventional router bit. In various embodiments, the side taper angle 140 can be from 13.5 degrees to 14.5 degrees. In an embodiment, the side taper angle is 14 degrees. The elongated main body 102 includes a height H selected to enable the elongated main body 102 to remain fully within the slot made by the conventional ½" router bit with the 14 degree taper. In various embodiments, a height H can range from 0.25" to 0.27". In an embodiment, the height H is 0.26". Stud 130 includes a stud length Ls. In various embodiments, the stud length Ls may be any length necessary to accommodate a workpiece expected to be encountered. In certain embodiments, the stud length Ls ranges from ½" to 1.5".

Figure 3:
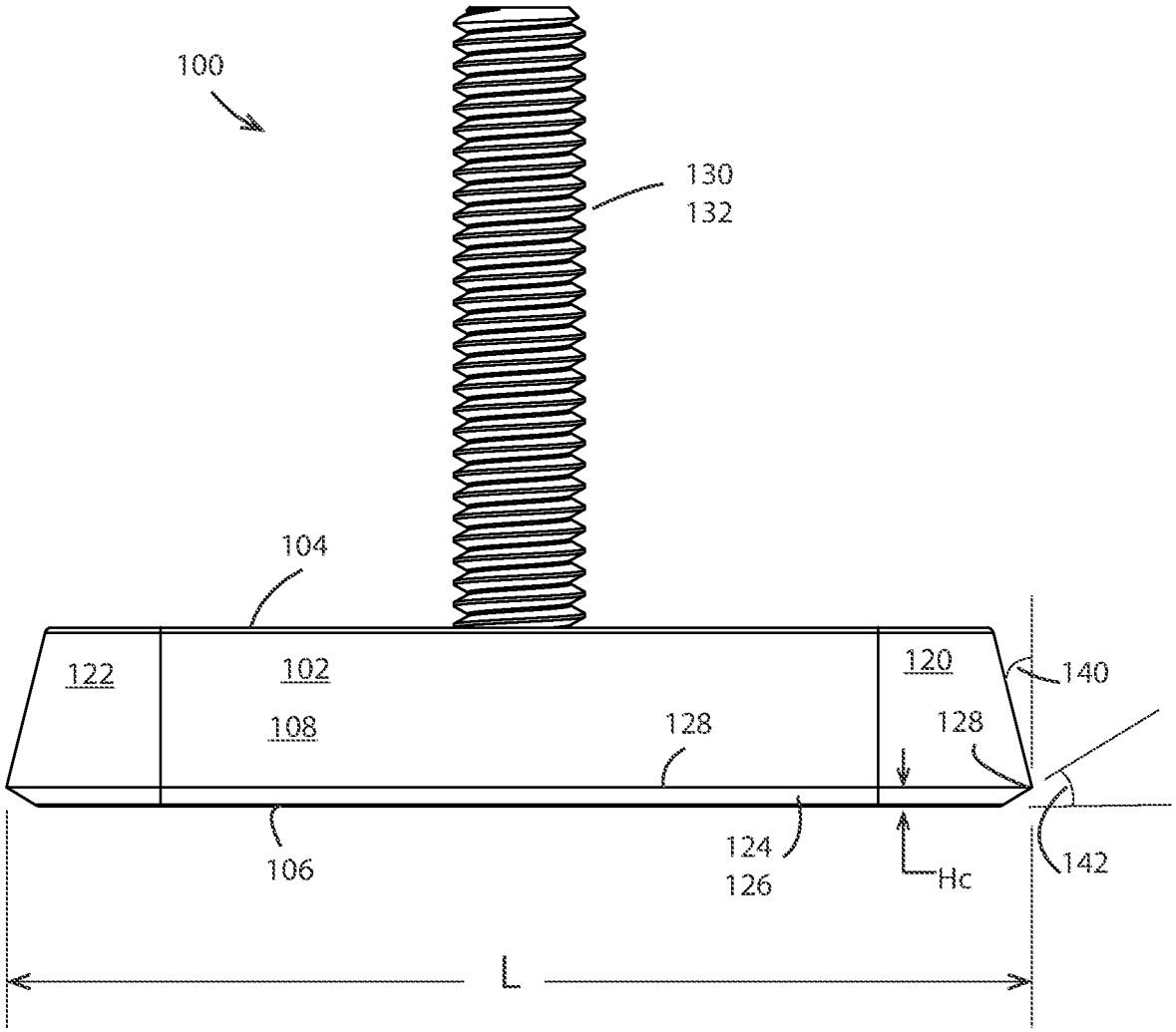
FIG. 3 is a side view of the dovetail anchor nut of FIG. 2.
Figure 4:
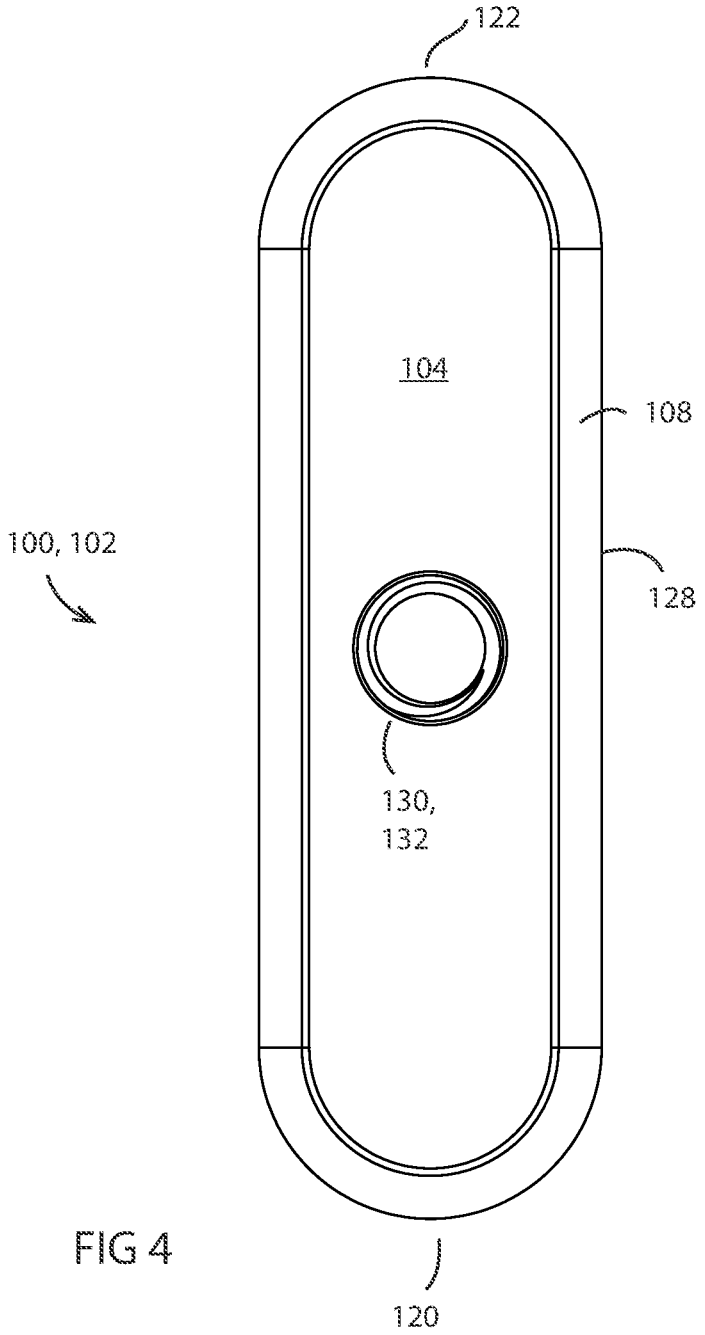
FIG. 4 is a top view of the dovetail anchor nut of FIG. 2.
Figure 5:
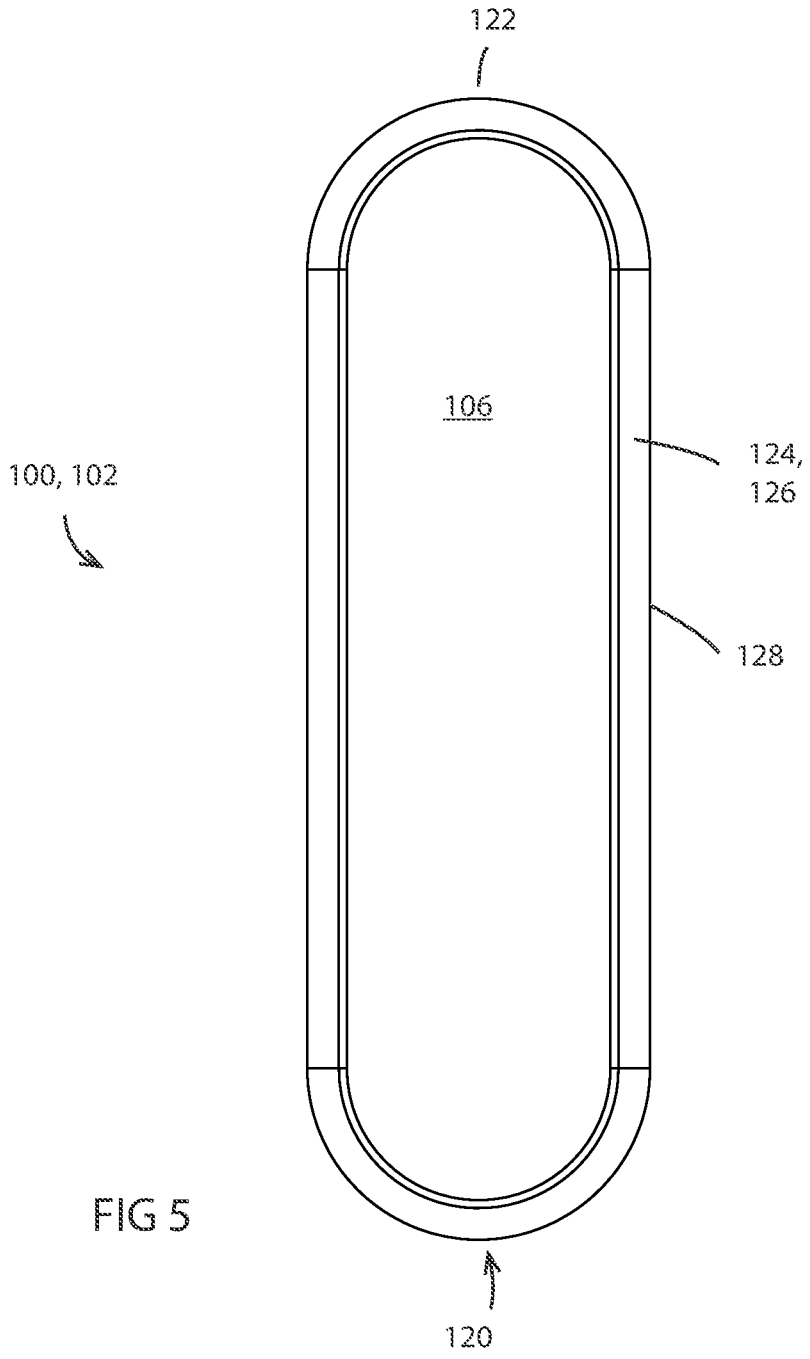
FIG. 5 is a bottom view of the dovetail anchor nut of FIG. 2.

As is best seen in FIG. 3, the elongated main body 102 includes a length L. In the embodiment shown, the length L is at least twice the width W (e.g. a maximum width). In various embodiments, the length L can range from 1.25" to 1.5". In an embodiment, the length L is at least 1.0" (e.g. at least twice a width of the conventional ½" router bit).

The chamfer 124 has a chamfer angle 142. In various embodiments, the chamfer angle 142 can be from 28 degrees to 32 degrees. In an embodiment, the chamfer angle 142 is 30 degrees. The chamfer 124 has a chamfer height Hc that, in various embodiments, ranges from 0.025" to 0.030". In certain embodiments, the height Hc ranges from 0.27" to 0.29". In an embodiment, the chamfer height Hc is 0.028". The chamfer 124 acts as a ramp of chamfer height Hc as is discussed below.

Figure 6:
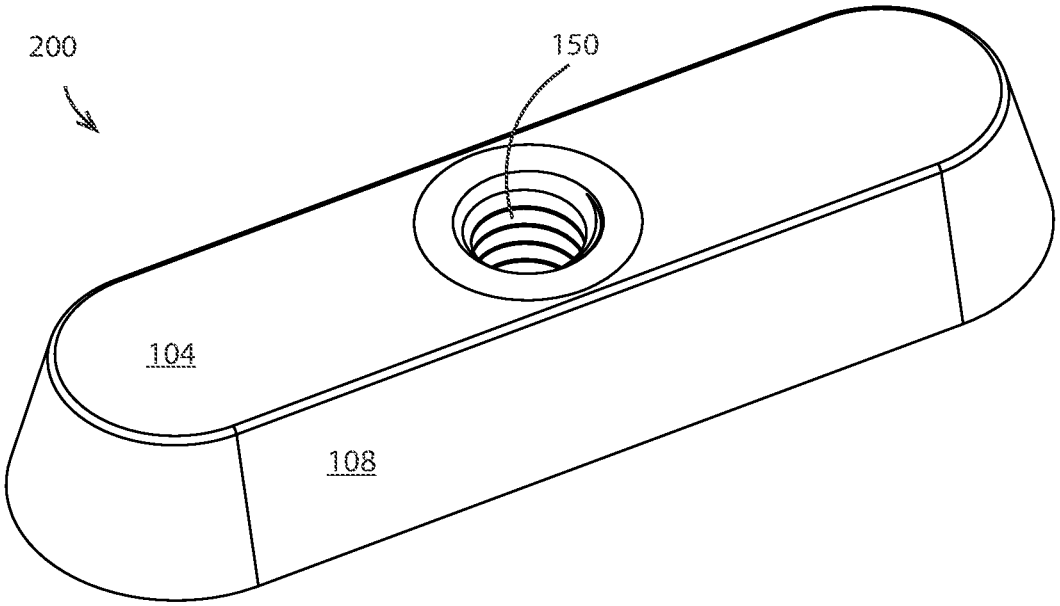
FIG. 6 is a perspective view of an alternate embodiment of the dovetail anchor nut.

FIG. 6 is a perspective view of an alternate embodiment of the dovetail anchor nut 200. This embodiment of the dovetail anchor nut 200 differs from that of FIGS. 1-5 only in that the stud 130 with the male thread 132 is not present. Instead, a female thread 150 is present into which a male threaded fastener may be secured.

Figure 7:
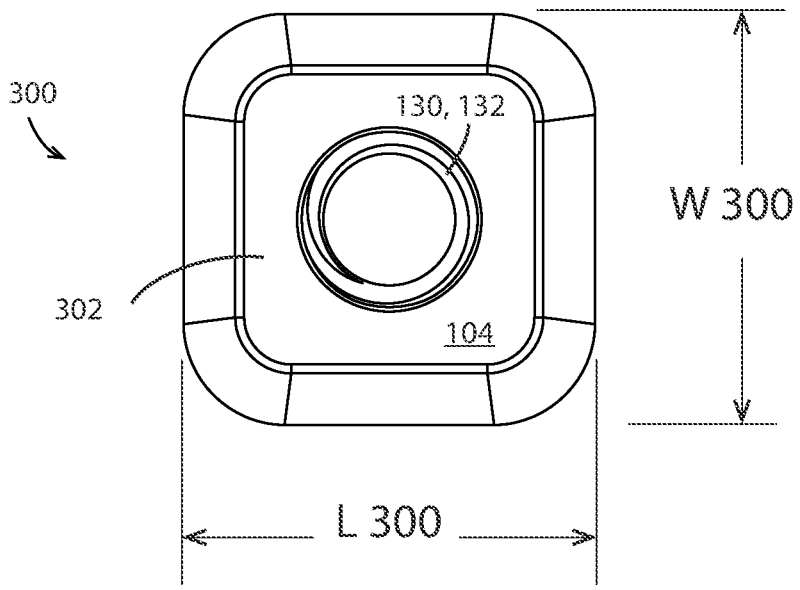
FIG. 7 is a top view of another alternate embodiment of the dovetail anchor nut.
Figure 8:
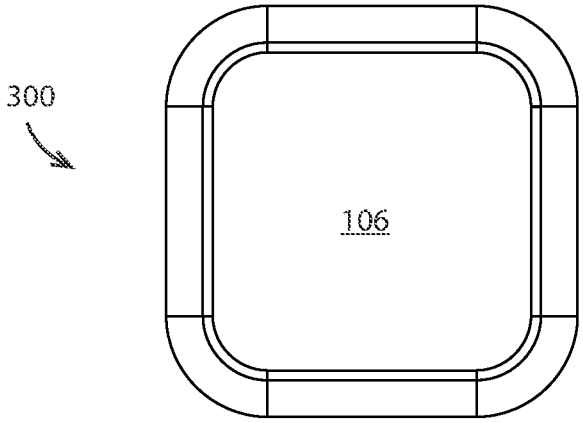
FIG. 8 is a bottom view of the dovetail anchor nut of FIG. 7.
Figure 9:
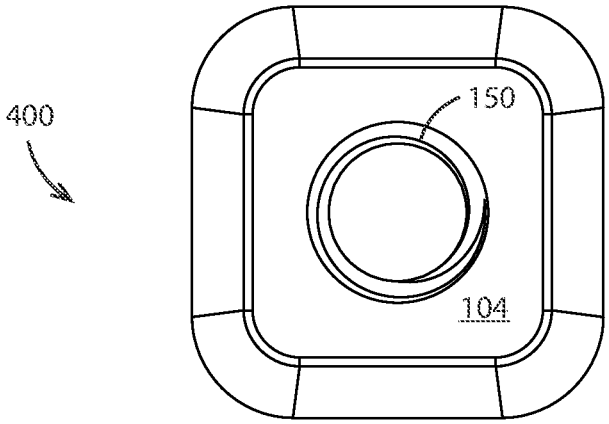
FIG. 9 is a top view of an alternate embodiment of the dovetail anchor nut.

FIG. 7 is a top view of another alternate embodiment of the dovetail anchor nut 300. This embodiment of the dovetail anchor nut 300 differs from that of FIGS. 1-5 only in that a length L300 of the main body 302 is less than twice a width W300 of the main body 302. The length L300 of the main body 302 ranges from less than twice the width W300 to being equal to the width W300 (e.g. square). This embodiment includes the stud 130 with the male thread 132. FIG. 8 is a bottom view of the dovetail anchor nut 300 of FIG. 7. FIG. 9 is a top view of an alternate embodiment of the dovetail anchor nut 400. This embodiment of the dovetail anchor nut 400 differs from that of FIGS. 7-8 only in that the stud 130 with the male thread 132 is not present. Instead, the female thread 150 is present into which a male threaded fastener may be secured.

Figure 10:
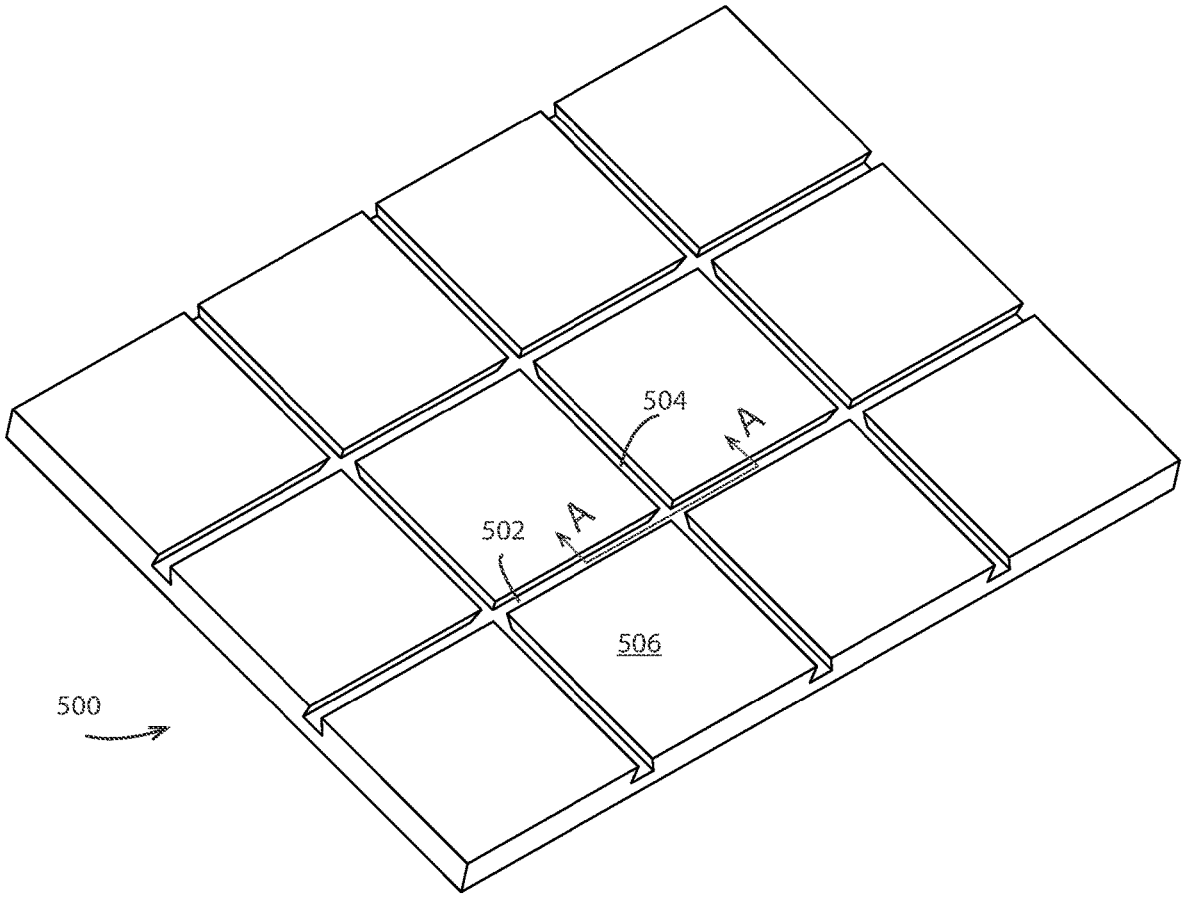
FIG. 10 is a perspective view of a panel with dovetail slots suitable for use with the dovetail anchor nut.

FIG. 10 is a perspective view of a panel 500 with dovetail slots 502, 504 in a top surface 506 of the panel 500. The dovetail slots 502, 504 are suitable for use with the dovetail anchor nut. Such a panel 500 is suitable, for example, for use by woodworking enthusiasts seeking to secure workpieces for woodworking operations.

Figure 11:
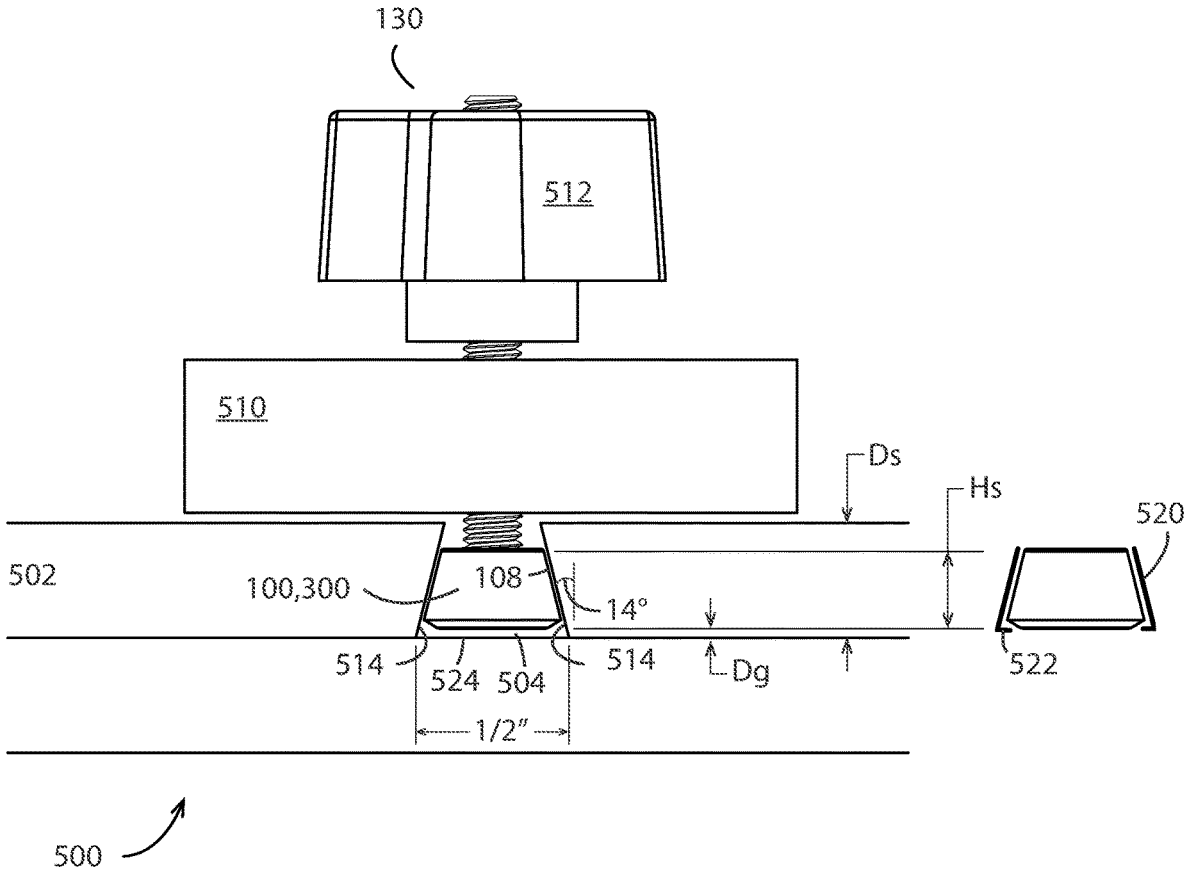
FIG. 11 is a cross sectional view along line A-A of FIG. 10 showing a dovetail anchor nut in use.

FIG. 11 is a cross sectional view along line A-A of FIG. 10 showing a dovetail anchor nut 100 (or 300) in use. Dovetail slots 502, 504 conform to a shape made by a conventional ½" router bit having a 14 degree taper. The dovetail anchor nut 100 is disposed in a slip fit in the dovetail slot 504. The stud 130 extends upward through a workpiece 510 and into a cooperating nut 512. Optionally, a washer can be disposed between the nut 512 and the workpiece 510. Tightening the nut 512 lifts the dovetail anchor nut 100 upwards in the dovetail slot 504 until the side surface 108 contacts slot sidewalls 514. Further tightening of the nut 512 clamps the workpiece 510 in position. The sidewalls 514 of the dovetail slot 504 may yield slightly during this process. This yielding may result in the dovetail anchor nut 100 becoming slightly wedged into place and held in place via force generated by a resilience of the wood surrounding the wedged dovetail anchor nut 100. When so wedged, the dovetail anchor nut 100 may remain in place even when the cooperating nut 512 is loosened. In this scenario, the dovetail anchor nut 100 can be dislodged simply by tapping on it in a downward direction.

When viewed as seen in FIG. 11, it can be seen that a size and shape of the elongated main body 102 matches a size and shape of a frustoconical section 520 of the dovetail slot 502, 504 made by the conventional ½" router bit with a 14 degree taper into which the elongated main body 102 slip fits. The frustoconical section 520 represents a middle portion of the dovetail slot 502, 504 that doesn't include the top or the bottom of the dovetail slot 502, 504. The frustoconical section 520 between the top and the bottom of the dovetail slot 502, 504 has the size and shape that the elongated main body 102 matches. A bottom 522 of the frustoconical section 520 is spaced apart from a bottom 524 of the dovetail slot 502, 504 by a gap distance Dg. A slot depth Ds may range up to 0.4". In various embodiments, the gap distance Dg can range from 0.01" and up. In an embodiment, the gap distance Dg is 0.14". Accordingly, a height Hs of the frustoconical section 520 is 0.4" Hs minus 0.14" Ds. In an embodiment, height Hs of the frustoconical section 520 is 0.26".

Figure 11A:
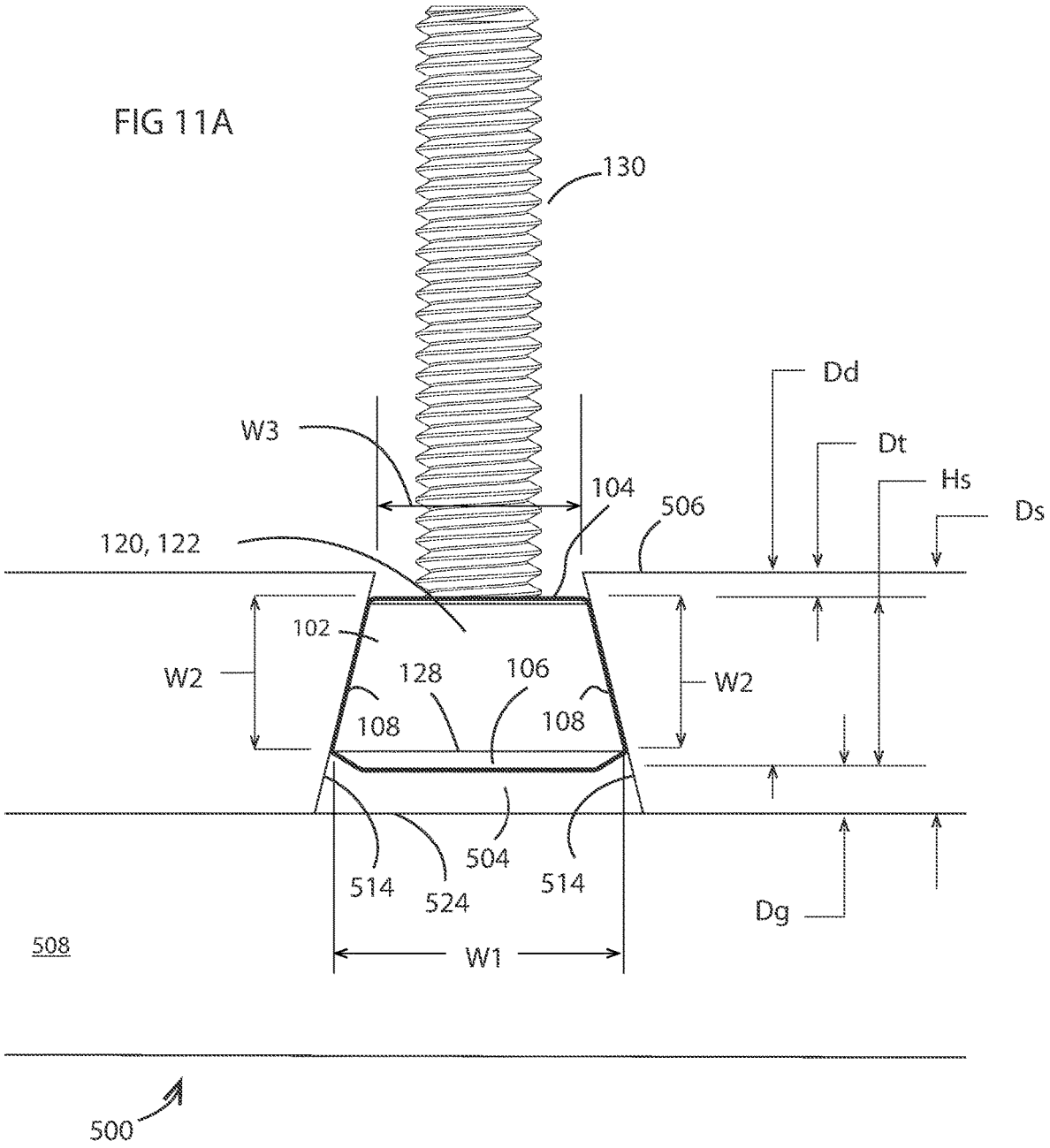
FIG. 11A is a close-up view of FIG. 11.

FIG. 11A is a close-up of the dovetail anchor nut 100 (or 300) in use. The top surface 506 of the panel 500 is visible, as is a remainder 508 of the panel 500 below the dovetail slots 502, 504. Top distance Dt is a distance between the top surface 506 of the panel 500 and the top surface 104 of the elongated main body 102. Dimension Dd equals top distance Dt plus height Hs of the frustoconical section 520. Width W1 is a widest width (e.g. a maximum width) at the first end 120 and at the second end 122. Width W2 is a virtual height on sidewalls 514 and is equivalent to the perpendicular height of the side surface 108 (without the chamfer 124). Width W3 is a width of a top opening of the dovetail slot having a profile of ½"×14 degree taper×⅜" deep.

Prior art anchor nuts of differing configurations are pulled upward against thin wood lips (e.g. corners) at the top of the dovetail slot 504. The prior art anchor nuts do not have the shape disclosed herein, so the upward forces are spread over relatively small contact points between the prior art anchor nut and the sidewall 514. Large forces over small contact areas causes relatively high stress which easily breaks the thin wood lips. In contrast, when the elongated main body 102 is pulled up by the nut 512, the side surface 108 of the dovetail anchor nut 100 contacts the sidewall 514 flush. This stops the upward movement of the elongated main body 102 and also spreads the contact force across a much greater interface.

When the side surface 108 of the elongated main body 102 rests flush against the sidewall 514, the height Hs of the frustoconical section 520 (and hence the height H of the elongated main body 102) is less than dimension Dd. This forms top distance Dt. In various embodiments, dimension Dd ranges from about 0.030" to 0.040". Having this size for dimension Dd leaves enough room for wood movement and expansion under clamping pressure. This helps ensure the workpiece 510 (not shown) is clamped onto the top surface 506 of the panel 500. When the dovetail slot has a profile of ½"×14 degree taper×⅜" deep, width W3 is 5/16". If the cutting depth is less than ⅜" deep, then width W3 will be larger than 5/16". In this case, top distance Dt is reduced or possibly eliminated. If top distance Dt is zero, the clamping force may clamp the workpiece 510 between the nut 512 and the top surface 104 of the dovetail anchor nut 100 instead of between the nut 512 and the top surface 506 of the panel 500.

Figure 12:
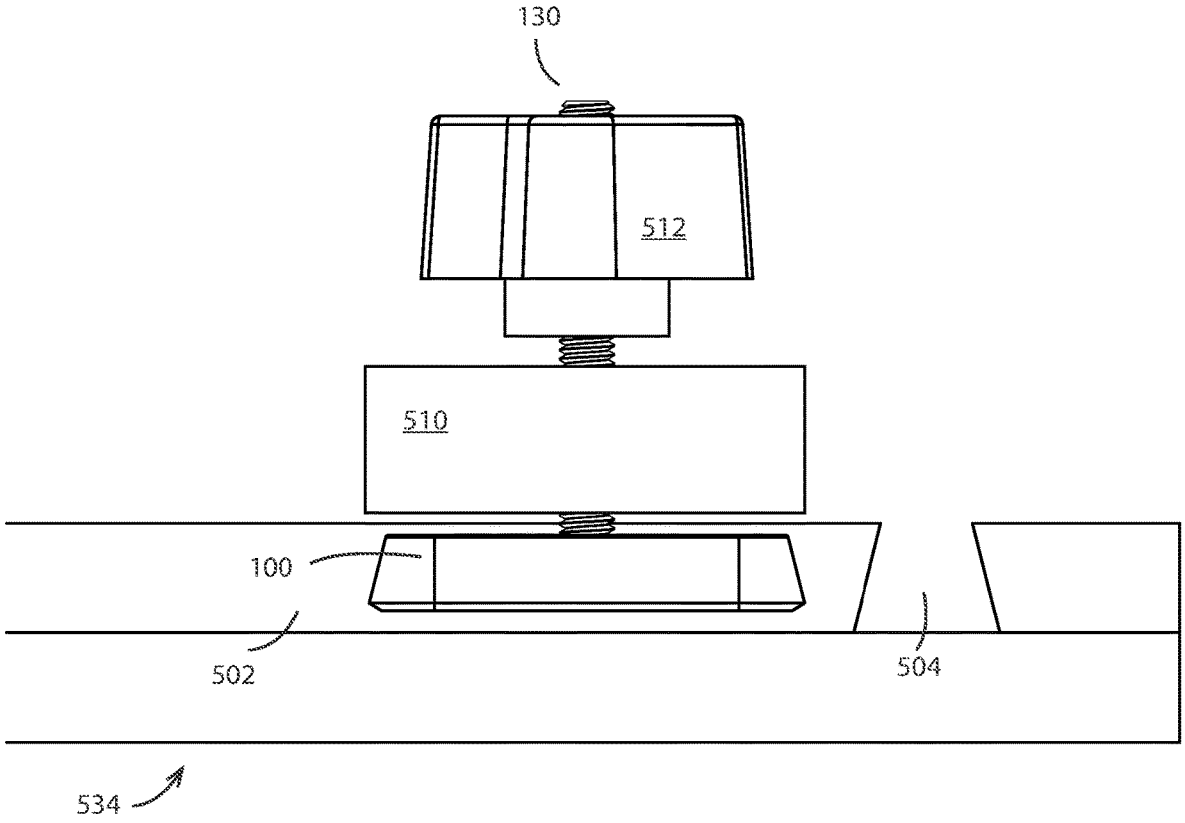
FIG. 12 is a cross sectional view along line A-A of FIG. 10 showing the dovetail anchor nut of FIG. 1 in use.

FIG. 12 is a cross sectional view along line A-A of FIG. 10 showing the dovetail anchor nut 100 securing a workpiece 510 in dovetail slot 502.

Figure 13:
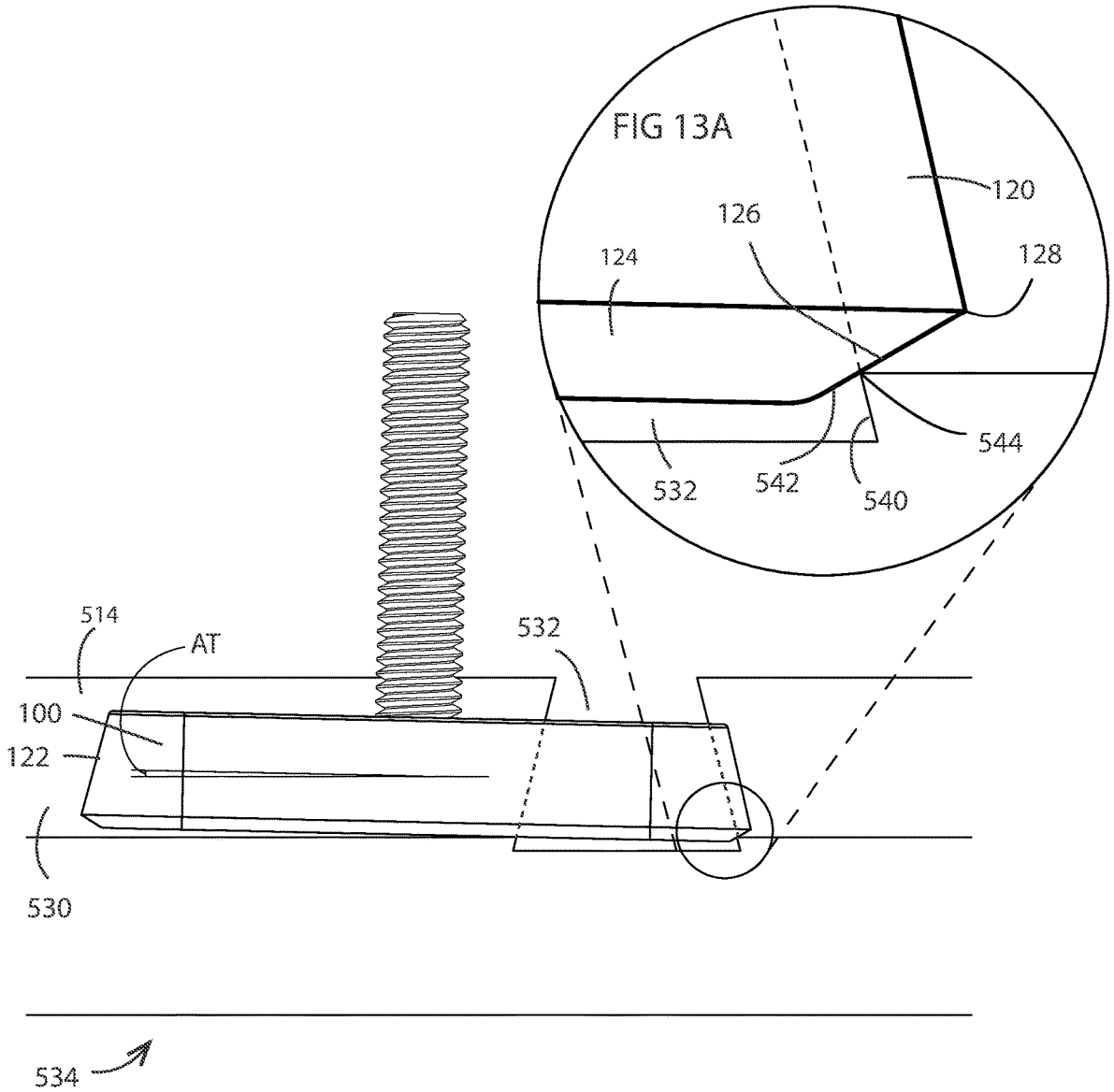
FIG. 13 is a cross sectional view showing the dovetail anchor nut of FIG. 1 in use.

FIG. 13 is a cross sectional view showing the dovetail anchor nut 100 of FIG. 12 in slot 530 and translating to the right in an effort to cross slot 532 of panel 534. Panel 534 differs from panel 500 of FIG. 10 in that a step 540 is formed where slot 530 intersects with slot 532. Such steps can result from the manufacturing of the panel 534 for a variety of reasons. For example, the router bit depth may change between the slots, or the panel itself may vary in thickness, be bowed, or twisted etc. The length L of the elongated main body 102 in the slot 530 limits a tilt angle AT of the elongated main body 102. In an embodiment, when the second end 122 abuts sidewalls 514 of the slot 532, the resulting tilt angle AT is 1.25 degrees. The chamfer 124 creates a ramp 542. The limited tilt angle AT and the chamfer 124 cooperate to keep the top 128 of the chamfer 124 above an upper corner 544 of the step 540. By doing this, in all but the most extreme cases, the upper corner 544 will contact the chamfer 124 which acts like a ramp and ensures the elongated main body 102 passes over the step. Otherwise, without the chamfer 124, the corner 126 would catch on the step 540 which would halt the lateral translation of the dovetail anchor nut 100. Hence, the chamfer 124 is well suited for handling steps 540.

FIG. 13A is a close-up showing how the chamfer 124 at the corner 126 acts as a ramp 542 allowing the first end 120 to smoothly ride over the upper corner 544 formed in the slot 532. The limited tilt angle AT prevents the top 128 of the chamfer 124 from dropping below the upper corner 544, which thereby ensures the upper corner 544 encounters the chamfer 124/ramp 542 and permits the uninterrupted lateral translation of the dovetail anchor nut 100.

Figure 14A:
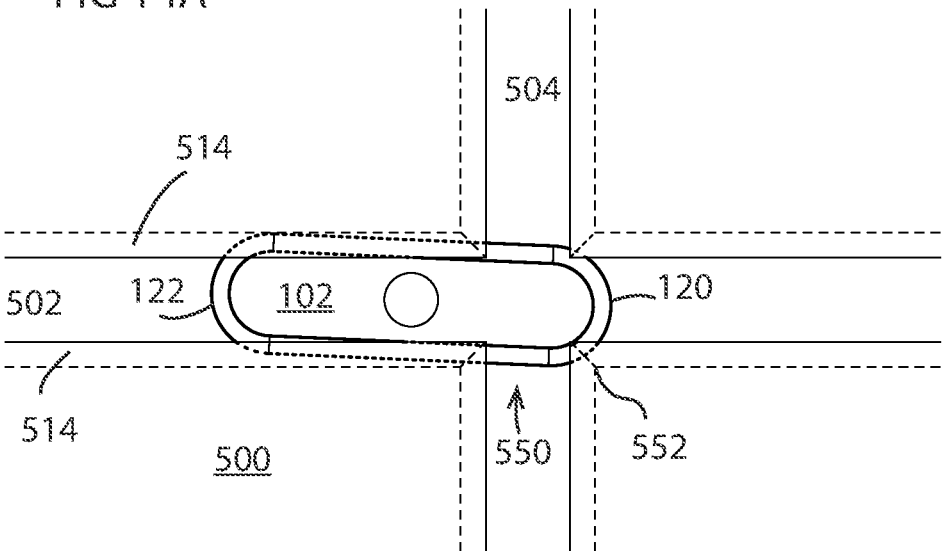
FIGS. 14A-14B show different embodiments of the dovetail anchor nut in use.
Figure 14B:
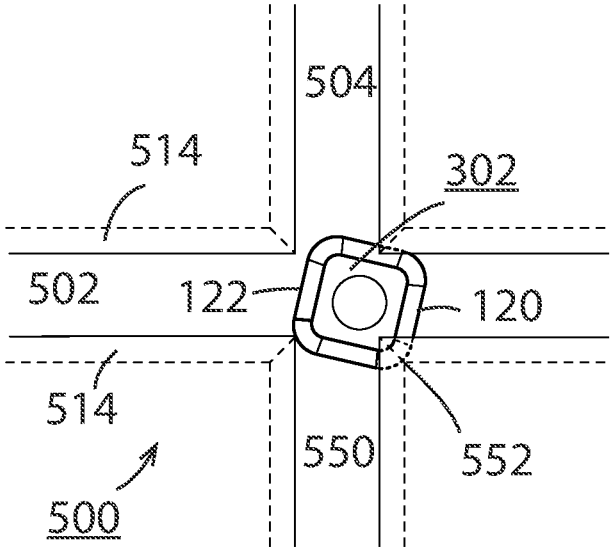

FIG. 14A shows the dovetail anchor nut 100 having the elongated body main of FIGS. 1-5 approaching an intersection 550 of the dovetail slots 502, 504 of the panel 500. FIG. 14B shows the dovetail anchor nut 300 having the main body 302 of FIG. 7 approaching the intersection 550 of the dovetail slots 502, 504 of the panel 500. It can be seen in FIG. 14A that the length L of the elongated main body 102 interacts with the slot sidewalls 514 of the dovetail slot 502 to keep the elongated main body 102 better aligned with the dovetail slot 502 than occurs with the main body 302 of the embodiment shown in FIG. 14B. Specifically, in FIG. 14A the elongated main body 102 clears an intersection corner 552 of the intersection 550. In FIG. 14B, the main body 302 may not clear the intersection corner 552 if the main body 302 is sufficiently misaligned with the dovetail slot 502. Hence, the lateral translation of the embodiment of FIG. 14A through the intersection 550 occurs without interruption, whereas the lateral translation of the embodiment of FIG. 14B through the intersection 550 may be interrupted in some instances. Hence, the dovetail anchor nut 100 with the elongated main body 102 is well suited for intersections 550. In various embodiments, the length L of the elongated main body is 2.5 to 3 times a dimension of a width of the intersection 550 of the dovetail slots 502, 504 and includes a first end 120 that is fully rounded, a second end 122 that is also fully rounded, and the chamfer 124 that acts as a ramp 542.

Figure 15:
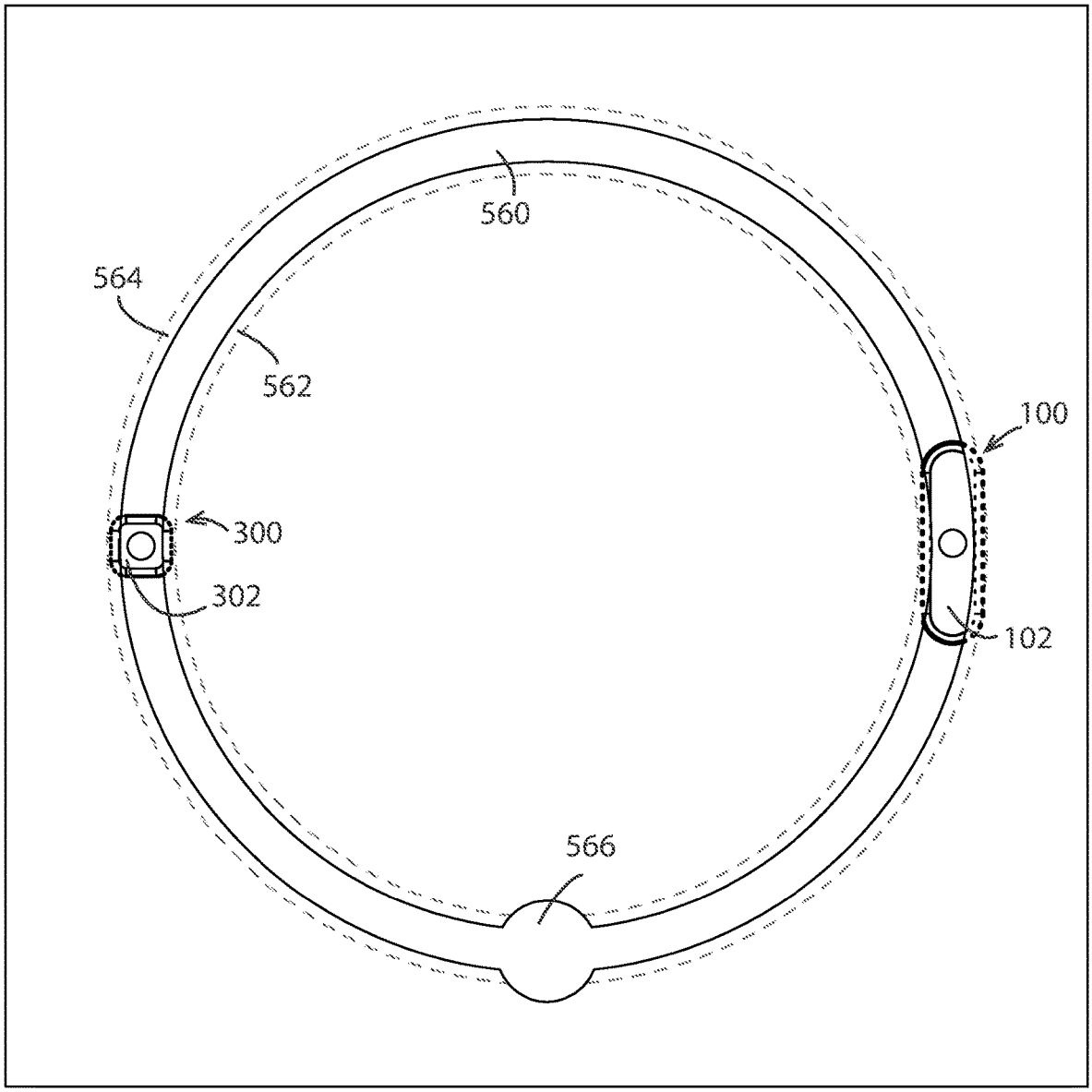
FIG. 15 shows different embodiments of the dovetail anchor nut in use.

FIG. 15 shows different embodiments of the dovetail anchor nut 100, 300 in a circular slot 560. The relatively shorter main body 302 of the dovetail anchor nut 300 on the left fits nicely between the curved inner sidewall 562 and the curved outer sidewall 564 because the main body 302. In contrast, in certain circumstances when the ratio of the length of the elongated main body 102 to the width of the elongated main body 102 is too great, the relatively longer elongated main body 102 of the dovetail anchor nut 100 on the right may be too long to fit within the curved inner sidewall 562 and the curved outer sidewall 564. The elongated main body 102 is shown as extending radially inward, through the curved inner sidewall 562 to illustrate the point. In reality, in those circumstances where the ratio is too high, the elongated main body 102 of the dovetail anchor nut 100 would simply not be able to fit through an entry 566 of the circular slot 560 or fit within the circular slot 560. Hence, the dovetail anchor nut 300 with the main body 302 is well suited for circular slots 560.

Figure 16A:
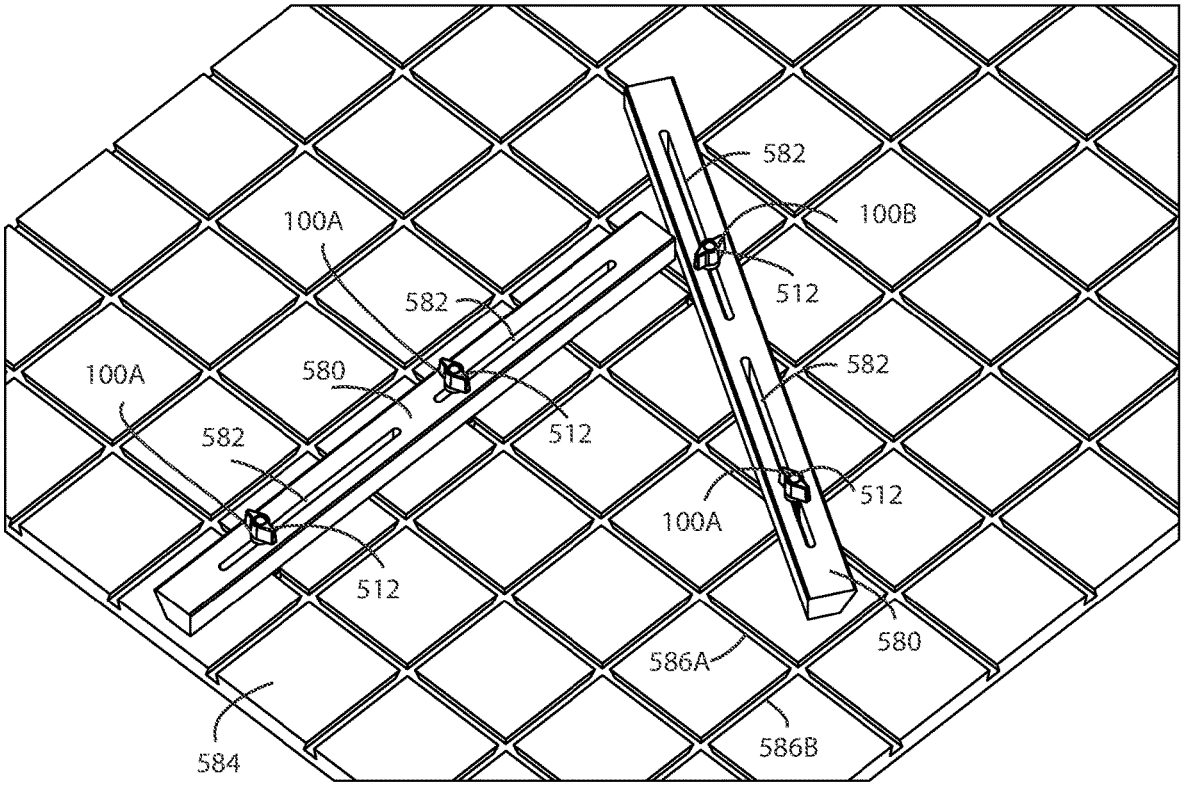
FIGS. 16A-16B show an assembly held in various configurations via dovetail anchor nuts.
Figure 16B:
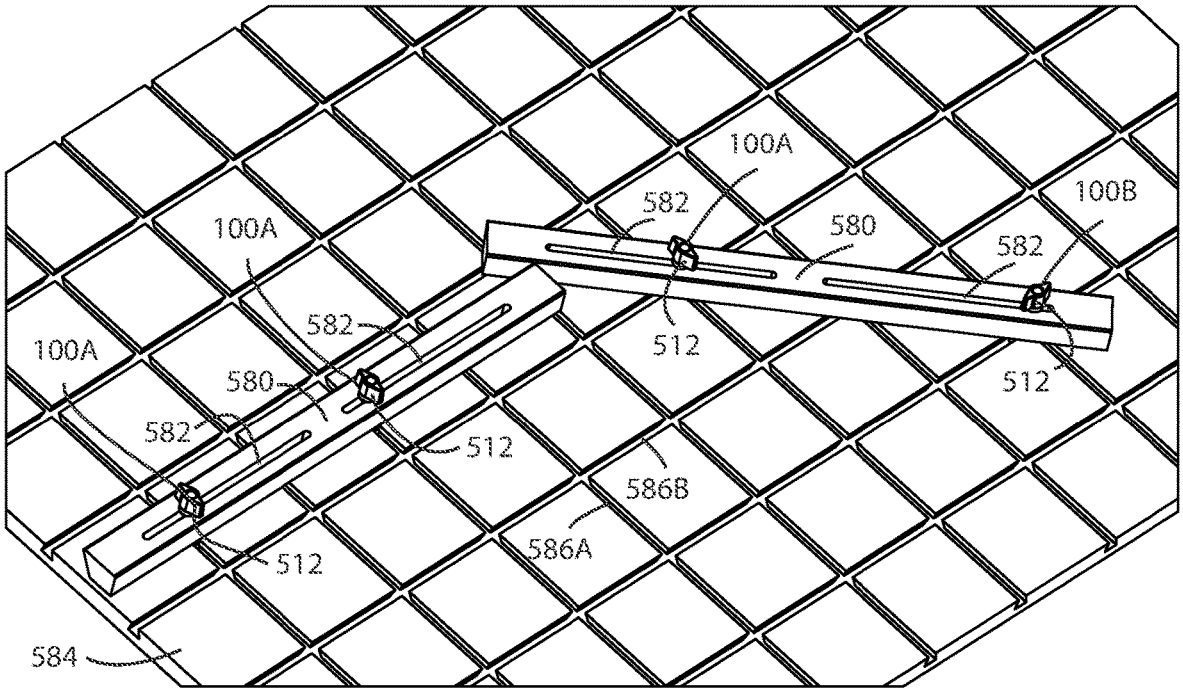

FIG. 16A shows fences 580 with slots 582 secured to a panel 584 using the dovetail anchor nuts 100A, 100B. The main body (not visible) is disposed in the slots 586A, 586B and each stud 130 protrudes through a respective slot 582. Nuts 512 secure the fences 580 to the panel 584. FIG. 16A shows the fences 580 in an acute angle configuration. FIG. 16B shows the fences 580 and dovetail anchor nuts 100A, 100B of FIG. 16A, but in an obtuse angle configuration. Changing the fences 580 from the acute angle configuration to the obtuse angle configuration can be as simple as loosening the nuts 512 of the right fence 580 but not removing the nuts 512, and once the nuts 512 are loose, rotating the fence 580 from its position in the acute angle configuration to its position in the obtuse angle configuration. This rotation is made possible by the movement of the dovetail anchor nuts 100A, 100B within the slots 586A, 586B in cooperation with movement of the stud 130 in the slots 582. This configuration makes it possible to rotate a fence 580 through 360 degrees. The 360 degree rotation can occur while the fence remains centered in the same spot on the panel 584. Rotation through 360 degrees is possible, for instance, when dovetail anchor nut 100A is disposed in slot 586A and dovetail anchor nut 100B is disposed in slot 586B, where slot 586B is perpendicular to slot 586A. This configuration also makes it possible to translate the fence 580 across the panel 584, as well as to move the panel 584 in a combination of rotation and translation. This freedom provides tremendous versatility to the woodworker.

Figure 17:
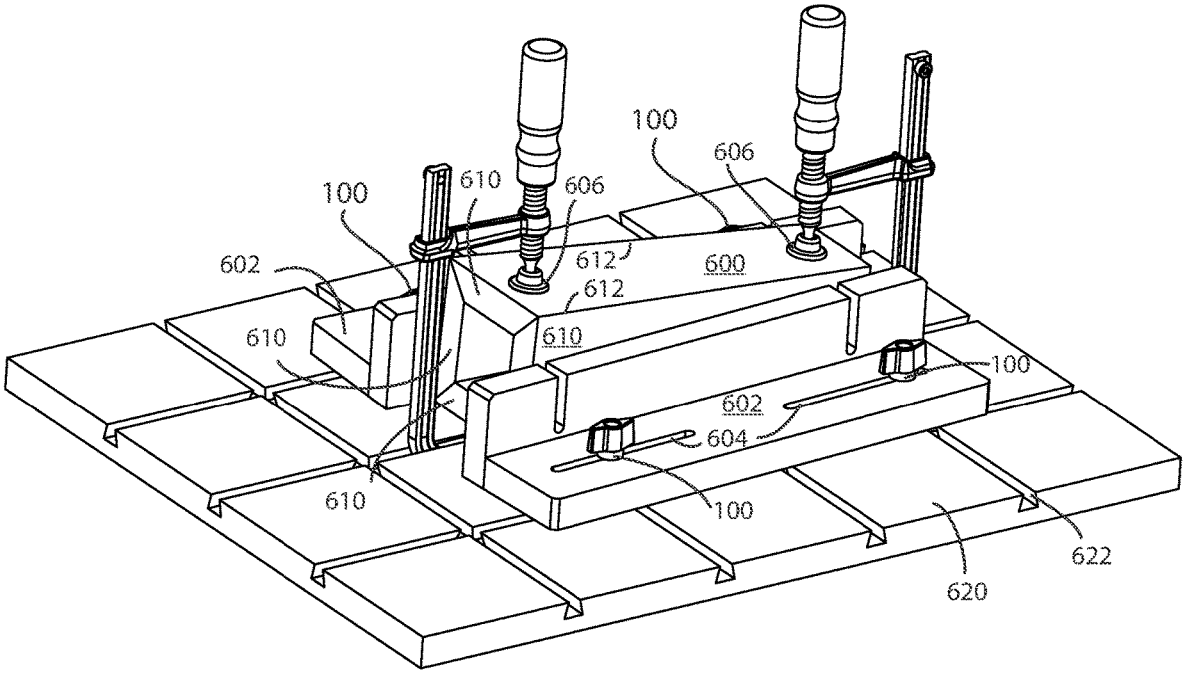
FIG. 17 shows an assembly held in position via dovetail anchor nuts.

FIG. 17 shows a tapered assembly 600 held in position via fences 602 having slots 604, clamps 606, and dovetail anchor nuts 100. In this embodiment, the clamps 606 are Microjig MATCHFIT™ clamps. The tapered assembly 600 shown has four individual pieces 610. Each piece is tapered along its longest dimension, and each piece 610 has mitered edges that form mitered corners 612 of the tapered assembly 600. Securely holding this tapered assembly 600 in place is made relatively simply due to the freedom provided by the dovetail anchor nuts 100 working with the slots 604. Specifically, the fences 602 are able to be secured to the panel 620 so that they are not aligned with the slots 622. This enables the fences 602 to accommodate the taper along the longest dimension of the tapered assembly 600. The fences 602 constrain the tapered assembly 600 therebetween, and the clamps 606 provide the normal clamping force. This further demonstrates some of the tremendous versatility made possible to the woodworker by the dovetail anchor nut 100.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising:

a main body comprising a dovetail shape, a top surface, a bottom surface, a side surface connecting the top surface and the bottom surface, a first end, a second end, and a chamfer at a corner of the side surface and the bottom surface at both the first end and the second end;

wherein the main body is elongated and configured to fit within a 0.4 inch deep dovetail slot comprising a ½ inch wide bottom and sidewalls that each taper inward at 14 degrees from a respective corner of the bottom, while being set apart from the bottom of the dovetail slot by a gap of at least 0.02 inches;

wherein the side surface comprises an oval shape comprising parallel side portions and rounded end portions;

wherein the rounded end portions are tapered inward from a top of the chamfer to the top surface; and a female thread or a stud comprising a male thread and projecting vertically from the top surface.

2. The apparatus of claim 1, wherein a length of the main body is at least one inch (1").

3. The apparatus of claim 1, wherein the chamfer extends fully around the main body.

4. The apparatus of claim 1, wherein a length of the main body is at least twice a maximum width of the main body.

5. The apparatus of claim 1, comprising the stud, wherein the stud is disposed at a middle of the main body.

6. The apparatus of claim 1, wherein a width of the main body is 0.44 inches to 0.46 inches and a length of the main body is at least twice the width of the main body.

7. The apparatus of claim 1, wherein the chamfer comprises a chamfer height of 0.025 inches to 0.030 inches.

8. The apparatus of claim 1, further comprising the stud and a nut fastener configured to cooperate with the stud.

9. An apparatus, comprising:

an elongated main body comprising a dovetail shape, a top surface, a bottom surface, a side surface connecting the top surface and the bottom surface, a rounded first end, a rounded second end, and a chamfer at a corner of the side surface and the bottom surface that extends fully around the elongated main body;

a stud comprising a male thread projecting vertically from the top surface;

wherein the elongated main body is configured to fit entirely within a 0.4 inch deep dovetail slot comprising a ½ inch wide bottom and sidewalls that each taper inward at 14 degrees from a respective corner of the bottom while being set apart from the bottom of the dovetail slot by a gap of at least 0.02 inches;

wherein the side surface comprises a first side portion that extends parallel to and opposite a second side portion, a first end portion comprising a first radiused shape that is radiused about a first axis that bisects the dovetail shape, wherein the first radiused shape is directly connected to the first side portion to the second side portion, and a second end portion comprising a second radiused shape that is radiused about a second axis that bisects the dovetail shape, wherein the second radiused shape is directly connected to the first side portion to the second side portion;

wherein the first radiused shape and the second radiused shape are tapered inward from a top of the chamfer to the top surface, and wherein a length of the elongated main body is at least twice a width of the elongated main body.

10. The apparatus of claim 9, wherein the length of the elongated main body is at least one inch (1").

11. The apparatus of claim 9, wherein the stud is disposed at a middle of the elongated main body.

12. The apparatus of claim 9, wherein the width of the elongated main body is 0.44 inches to 0.46 inches.

13. The apparatus of claim 9, wherein the chamfer comprises a chamfer height of 0.025 inches to 0.030 inches.

14. The apparatus of claim 9, further comprising a nut fastener configured to cooperate with the stud.

* * * * *